US009072366B2

(12) United States Patent
Jensen et al.

(10) Patent No.: US 9,072,366 B2
(45) Date of Patent: Jul. 7, 2015

(54) UTILITY BUCKET BACKPACK APPARATUS

(71) Applicants: John V. Jensen, Richland, WA (US); Michael C. Gibbon, Richland, WA (US)

(72) Inventors: John V. Jensen, Richland, WA (US); Michael C. Gibbon, Richland, WA (US)

( * ) Notice: Subject to any disclaimer, the term of this patent is extended or adjusted under 35 U.S.C. 154(b) by 140 days.

(21) Appl. No.: 14/028,787

(22) Filed: Sep. 17, 2013

(65) Prior Publication Data

US 2015/0076202 A1 Mar. 19, 2015

(51) Int. Cl.

| | |
|---|---|
| ***A45F 3/14*** | (2006.01) |
| ***B65D 21/00*** | (2006.01) |
| ***A45F 3/04*** | (2006.01) |
| *B65D 21/02* | (2006.01) |

(52) U.S. Cl.

CPC ..... *A45F 3/04* (2013.01); *A45F 2003/142* (2013.01); *A45F 3/14* (2013.01); *B65D 21/0233* (2013.01)

(58) Field of Classification Search

CPC ..... A45F 3/04; A45F 2003/142
USPC ..... 224/259, 627, 250
See application file for complete search history.

(56) References Cited

U.S. PATENT DOCUMENTS

| | | | | |
|---|---|---|---|---|
| 2,169,080 | A * | 8/1939 | Clark | 224/639 |
| 5,154,303 | A * | 10/1992 | Jordan | 220/23.86 |
| 5,184,745 | A * | 2/1993 | Havens et al. | 220/23.83 |
| 5,579,966 | A * | 12/1996 | Krumweide et al. | 224/637 |
| 5,915,606 | A * | 6/1999 | Jensen | 224/148.6 |
| 5,918,785 | A * | 7/1999 | Irose | 224/259 |
| 6,851,566 | B1 * | 2/2005 | Bonner | 220/4.27 |
| 6,938,761 | B2 * | 9/2005 | Nish | 206/315.11 |
| 7,387,224 | B1 * | 6/2008 | Backus | 224/42.11 |
| D591,008 | S * | 4/2009 | Barringer | D30/133 |
| 7,543,726 | B2 * | 6/2009 | MacNaughton | 224/679 |
| 7,971,763 | B2 * | 7/2011 | Chace | 224/259 |
| 8,251,269 | B2 * | 8/2012 | Winneur | 224/629 |
| 8,322,530 | B2 * | 12/2012 | Furlong | 206/508 |
| D677,895 | S * | 3/2013 | Camp, III | D3/318 |
| 2007/0084893 | A1 * | 4/2007 | Godshaw et al. | 224/257 |

* cited by examiner

*Primary Examiner* — Justin Larson
(74) *Attorney, Agent, or Firm* — Douglas E McKinley, Jr.

(57) ABSTRACT

A utility bucket backpack apparatus having an upper strap and a lower strap may have each of the upper and lower straps connected to two backpack straps. The lower strap may further be connected to a bottom strap. The upper strap may further be connected to two handle straps. The upper strap and the lower strap may also be removably connected to the outer circumference of a utility bucket.

3 Claims, 4 Drawing Sheets

UTILITY BUCKET BACKPACK APPARATUS

RELATED APPLICATIONS

This application claims the benefit of US Provisional Application No. 61/701,806 filed on Sep. 17, 2012, the disclosure of which Application is incorporated by reference herein.

TECHNICAL FIELD

This invention relates to storage and transportation devices. More specifically, this invention relates to improved designs for devices for transporting materials and improved designs for backpacks.

BACKGROUND OF THE INVENTION

There have been a number of examples of backpacks. Typically, these consist of a soft fabric container area for holding items that a user desires to carry attached to two shoulder straps that are worn by a user. The present invention provides additional and enhanced features and advantages when contrasted with these prior art designs.

SUMMARY OF THE INVENTION

A utility bucket backpack apparatus may include an upper strap and a lower strap. Each of said upper and lower straps may be connected to at least one backpack strap. The upper strap and the lower strap are capable of being removably attached to the outer circumference of a utility bucket.

A utility bucket backpack apparatus having an upper strap and a lower strap may have each of the upper and lower straps connected to two backpack straps. The lower strap may further be connected to a bottom strap. The upper strap may further be connected to two handle straps. The upper strap and the lower strap may also be removably connected to the outer circumference of an outer utility bucket. A bottom strap may be attached to the lower strap and may extend across the bottom of an outer utility bucket. An inner utility bucket may be removably set within the outer utility bucket. A pad may be attached to the exterior of the outer utility bucket. The pad may be positioned in between the two backpack straps during use. A utility bucket lid may be attached to the bottom of the outer utility bucket.

BRIEF DESCRIPTION OF THE DRAWINGS

The following detailed description of the embodiments of the invention will be more readily understood when taken in conjunction with the following drawing, wherein.

DETAILED DESCRIPTION OF THE PREFERRED EMBODIMENTS

Figure 1:
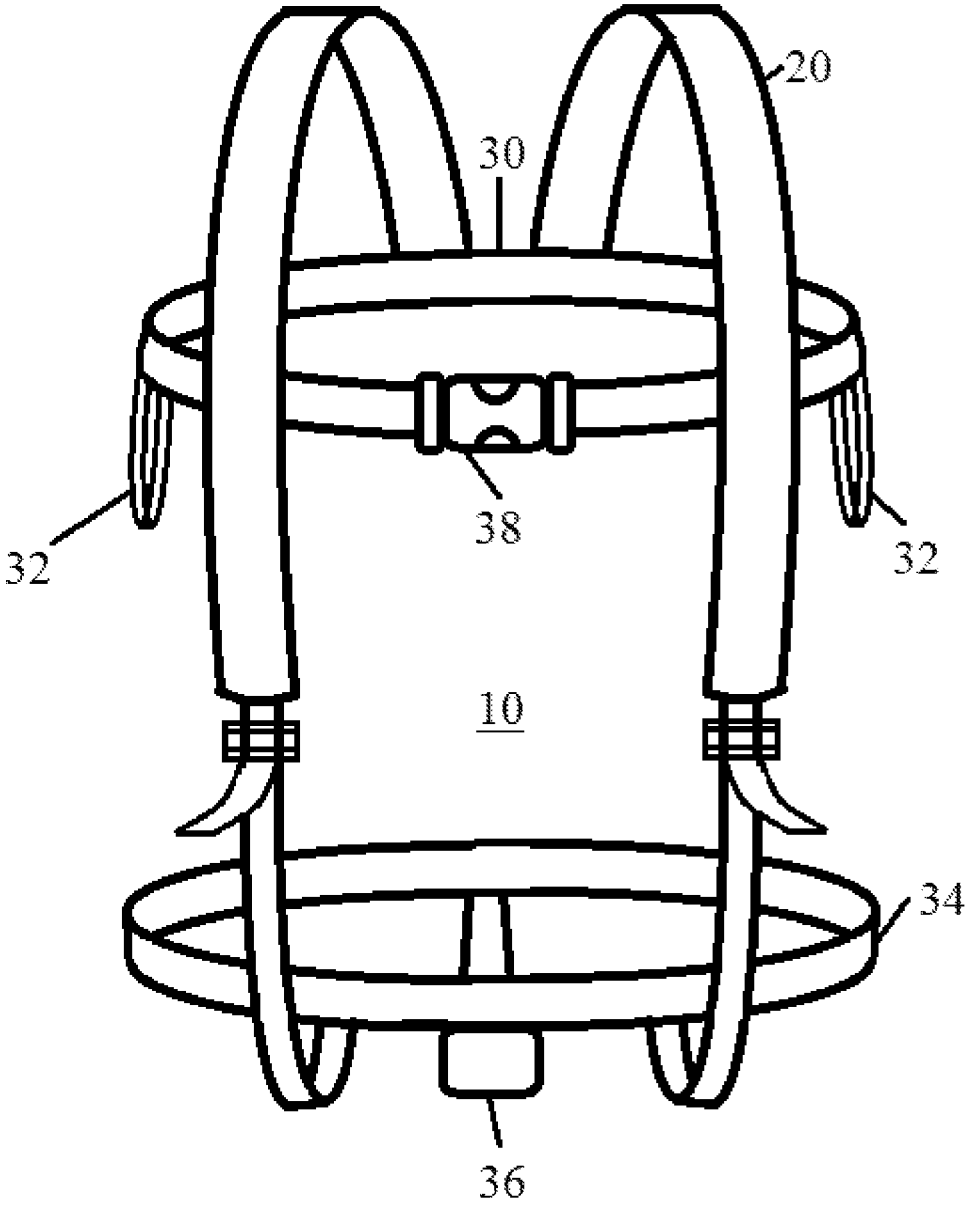
FIG. 1 is a frontal view of the utility bucket backpack apparatus prior to being attached to a utility bucket.

For the purposes of promoting an understanding of the principles of the invention, reference will now be made to the embodiments illustrated in the drawings and specific language will be used to describe the same. It will nevertheless be understood that no limitations of the inventive scope is thereby intended, as the scope of this invention should be evaluated with reference to the claims appended hereto. Alterations and further modifications in the illustrated devices, and such further applications of the principles of the invention as illustrated herein are contemplated as would normally occur to one skilled in the art to which the invention relates.

FIG. 1 shows the utility bucket backpack apparatus 10 prior to being attached to a utility bucket. The upper strap 30 may be made of webbing approximately 1 inch wide. The backpack strap 20 may have a padded upper portion sewn to the upper strap 30. The backpack strap 20 may have the lower webbing portion sewn to the lower strap 34. The lower strap 34 may be of 1 inch wide webbing. Handle straps 32 and a bottom strap 36 may be made of 1 inch wide webbing. The upper strap may have a conventional plastic side release buckle 38.

Figure 2:
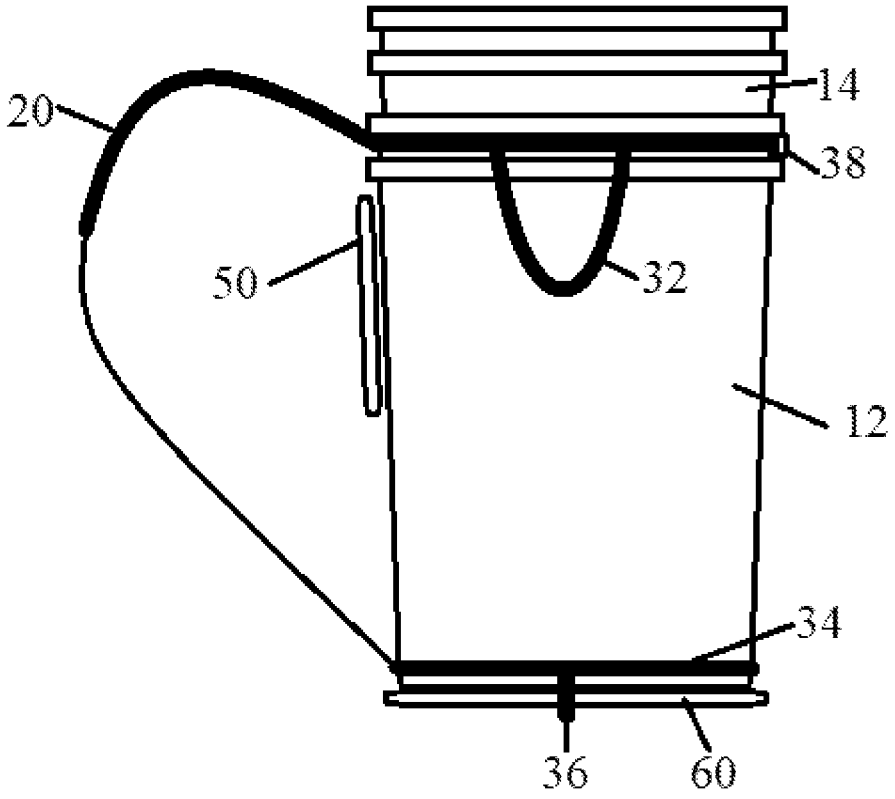
FIG. 2 is a side view of the utility bucket backpack apparatus being used in a backpack mode.

FIG. 2 shows utility bucket backpack apparatus attached to an outer utility bucket 12. Also pictured is an inner utility bucket 14. A lid, such as a conventional utility bucket lid 60, may be attached to the bottom of the outer utility bucket 12. A foam pad 50 may be added to the outer bucket 12, preferably where the users back touches the outer bucket 12.

FIG. 2 shows that upper strap 30 may be attached in between the raised portions of the outer bucket 12. The strap may be tightened by the use of a buckle, which may be a conventional plastic side release buckle 38.

The padded portion of the backpack strap 20 may be attached to the upper strap 30, while the lower web portion of the backpack strap 20, may be attached to the lower strap 34. The bottom strap 36 may extend under the outer bucket 12 and may be covered by a conventional lid 60 that may be attached to the bottom of the outer bucket 12. The handle straps 32 may be sewn onto the upper strap 30. The inner bucket 14 may be placed inside the outer bucket 12.

The outer bucket 12 may be slid into the lower strap 34. The lower strap 34 may sewn to size of a standard utility bucket. The bottom strap 36 may have its two ends sewn on to opposite sides of the lower strap 34. The bottom strap 36 may keep the lower strap 34 from sliding up the outer bucket 12. The upper strap 30 may be attached to the outer bucket 12 by tightening a conventional plastic side release buckle 38. The side handle strap 32 may be sewn to the upper strap 30. The backpack straps 20 may have their padded portion sewn to the upper strap 30 and the lower webbed portion sewn to the lower strap 34. The conventional utility bucket lid 60 may be attached with nuts and bolts to the bottom of the outer bucket 12. The inner bucket 14 may be put inside the outer bucket 12. The inner bucket 14 may be secured by a lid.

Figure 3:
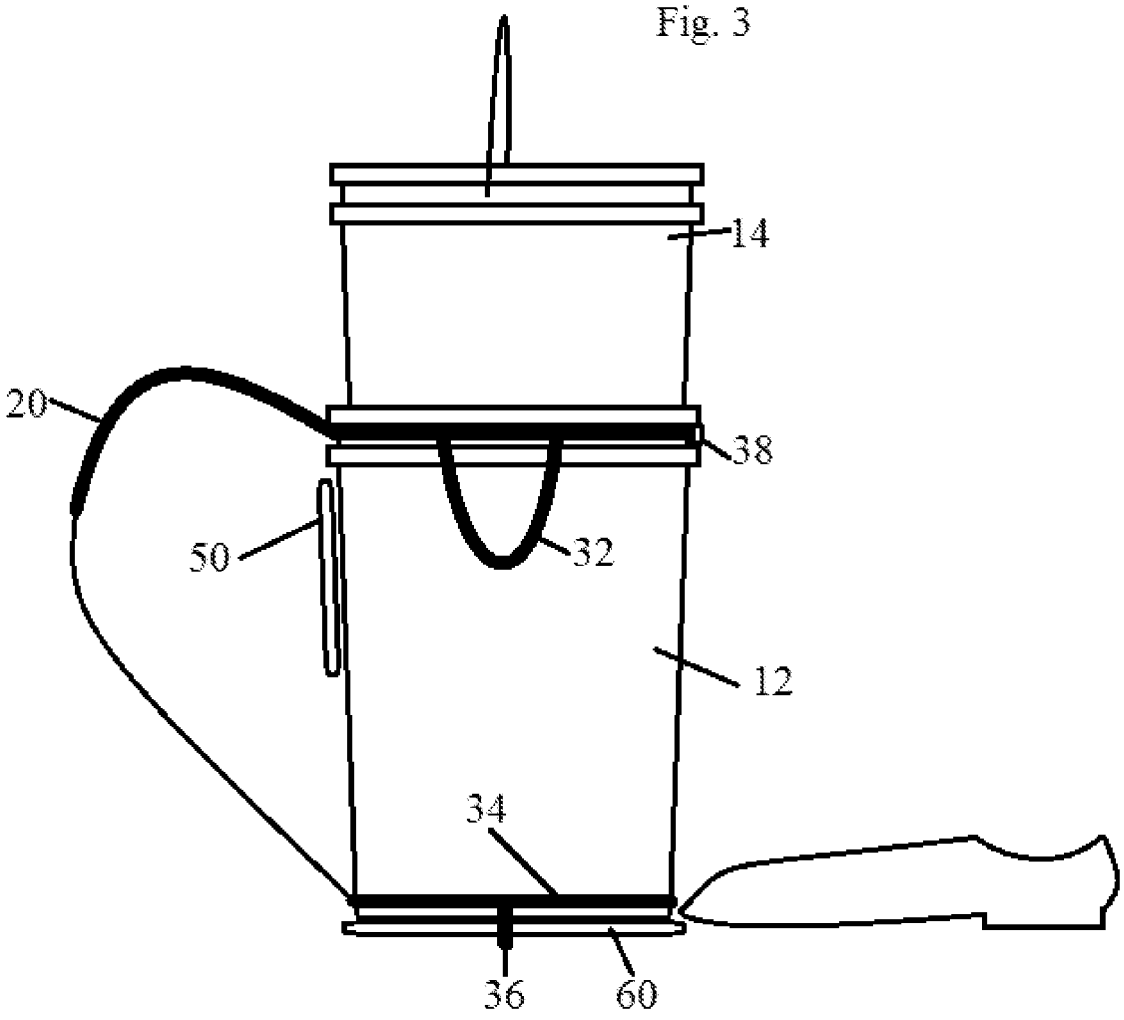
FIG. 3 is a side view of the inner utility bucket being removed from the outer bucket.

As shown in FIG. 2 the utility bucket backpack apparatus 10 allows the user to carry the inner utility bucket 14 inside the outer utility bucket 12. The user may carry the outer utility bucket 12 and the inner utility bucket 14 in backpack mode with the use of the backpack straps 20. The user may also carry the outer utility bucket 12 and the inner utility bucket 14 by the use of the side handle straps 32. As shown in FIG. 3, the user may then remove the inner bucket 14 from the outer bucket 12 by pulling up on the inner bucket's 14 handle. The user may step on the conventional utility bucket lid 60 attached to the bottom of the outer bucket 12. This will assist the user in holding the outer bucket 12 in place while pulling on the inner bucket 14.

Figure 4:
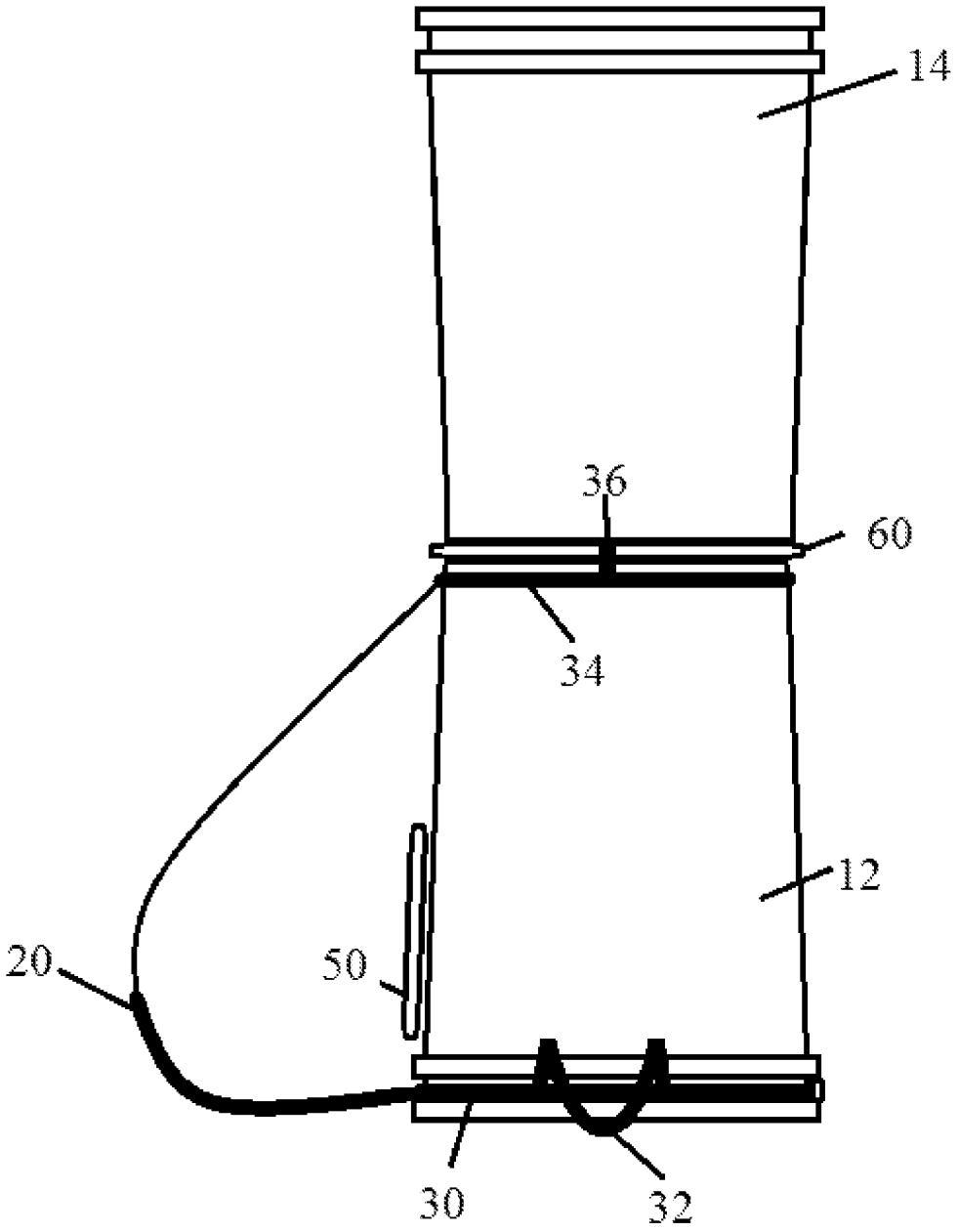
FIG. 4 is a side view of the outer bucket and the utility bucket backpack apparatus being inverted and being used as a stand.

As shown in FIG. 4, the outer bucket 12 may be inverted and used for a stand for the inner bucket 14. The outer bucket 12 may also be used for a seat. The items the user was carrying will continue to be contained in the inner bucket 14.

While the invention has been illustrated and described in detail in the drawings and foregoing description, the same is to be considered as illustrative and not restrictive in character. Only certain embodiments have been shown and described, and all changes, equivalents, and modifications that come within the spirit of the invention described herein are desired to be protected. Any experiments, experimental examples, or experimental results provided herein are intended to be illustrative of the present invention and should not be considered limiting or restrictive with regard to the invention scope. Further, any theory, mechanism of operation, proof, or finding stated herein is meant to further enhance understanding of the present invention and is not intended to limit the present invention in any way to such theory, mechanism of operation, proof, or finding.

Thus, the specifics of this description and the attached drawings should not be interpreted to limit the scope of this invention to the specifics thereof. Rather, the scope of this invention should be evaluated with reference to the claims appended hereto. In reading the claims it is intended that when words such as "a", "an", "at least one", and "at least a portion" are used there is no intention to limit the claims to only one item unless specifically stated to the contrary in the claims. Further, when the language "at least a portion" and/or "a portion" is used, the claims may include a portion and/or the entire items unless specifically stated to the contrary. Likewise, where the term "input" or "output" is used in connection with an electric device or fluid processing unit, it should be understood to comprehend singular or plural and one or more signal channels or fluid lines as appropriate in the context. Finally, all publications, patents, and patent applications cited in this specification are herein incorporated by reference to the extent not inconsistent with the present disclosure as if each were specifically and individually indicated to be incorporated by reference and set forth in its entirety herein.

The invention claimed is:

1. A utility bucket backpack apparatus comprising:

an upper strap and a lower strap, each of said upper and lower straps connected to two backpack straps, said lower strap further connected to a bottom strap, said upper strap further connected to two handle straps, an outer utility bucket and an inner utility bucket, wherein said upper strap and said lower strap are removably attached to the outer circumference of an outer utility bucket, said bottom strap extends across the bottom of the outer utility bucket, and the inner utility bucket is removably set within the outer utility bucket, a pad attached to the exterior of the outer utility bucket in between the two backpack straps, and a utility bucket lid attached to the bottom of the outer utility bucket.

2. The utility bucket backpack apparatus of claim 1 wherein the upper strap further comprises a side release buckle.

3. The utility bucket backpack apparatus of claim 1 wherein the side release buckle is formed of plastic.

* * * * *